US006253798B1

(12) United States Patent
Helwig

(10) Patent No.: US 6,253,798 B1
(45) Date of Patent: Jul. 3, 2001

(54) TRANSPARENT JEWELRY WIRE BENDER

(76) Inventor: Gary L. Helwig, 20213 Sweet Meadow La., Laytonsville, MD (US) 20882

( * ) Notice: Subject to any disclaimer, the term of this patent is extended or adjusted under 35 U.S.C. 154(b) by 0 days.

(21) Appl. No.: 09/671,142

(22) Filed: Sep. 28, 2000

Related U.S. Application Data

(63) Continuation of application No. 09/236,713, filed on Jan. 25, 1999, now abandoned.

(51) Int. Cl.[7] ..... B21F 3/00
(52) U.S. Cl. ..... 140/92.1; 29/896.4
(58) Field of Search ..... 140/92.1; 29/755, 29/850, 896.4, 896.41, 896.43

(56) References Cited

U.S. PATENT DOCUMENTS 1,042,112 10/1912 Hartman .
1,114,384 10/1914 Prime .
3,194,279 7/1965 Brown .
3,653,411 4/1972 Mosher et al. .
4,483,373 11/1984 Tarbox .
5,632,086 5/1997 Helwig .

FOREIGN PATENT DOCUMENTS 369637 11/1906 (FR) .

*Primary Examiner*—P. W. Echols
(74) *Attorney, Agent, or Firm*—Patent & Trademark Services; Joseph H. McGlynn

(57) ABSTRACT

A wire bending jig which has a plurality of apertures extending into the top face of the jig but stopping short of the opposite or bottom face. A plurality of pegs are placed into selected apertures to define a pattern for bending wire around the pegs into a specific shape. A pattern of the specific shape is attached to the bottom face of the jig, and the jig is transparent so the pattern can be seen from the top face, and so the pattern will be protected during the wire bending process.

7 Claims, 1 Drawing Sheet

TRANSPARENT JEWELRY WIRE BENDER

This is a continuation of Ser. No. 09/236,713, filed Jan. 25, 1999, now abandoned.

BACKGROUND OF THE INVENTION

This invention relates, in general, to jigs, and, in particular, to jigs for bending jewelry wire in a specific pattern.

DESCRIPTION OF THE PRIOR ART

In the prior art various types of wire bending jigs have been proposed. For example, U.S. Pat. No. 1,042,112 to Hartman discloses a wire bending tool having a base with a plurality of apertures in one face, and a plurality of pegs secured in selected apertures. In addition, a tool is shown which will assist the user in bending wire about the pegs.

U.S. Pat. No. 1,114,384 to Prime discloses a wire bending tool having a base with a plurality of apertures in one face, and a plurality of pegs secured in the apertures. In addition, a pattern is marked or scratched in the top surface of the base to assist the user in bending wire into a selected pattern.

U.S. Pat. No. 4,483,373 to Tarbox discloses a wiring harness jig with a plurality of pins about which wires will be bent, and a pattern sheet which is held in place by two wire frames, and pins are punched through the pattern sheet and into the base to assist the user in bending wire into a desired pattern.

French patent No. 369,637 to Vache discloses a wire bending jig having a base with a plurality of holes placed thereon and a plurality of pegs in different sizes which can be secured to the base to assist the user in bending wire into a desired pattern.

U.S. Pat. No. 3,194,279 to Brown discloses a wire harness jig having a base and a plurality of pins extending through a transparent base and extending a distance on the bottom of the base. Guide wires are wrapped around the ends of the pins on the bottom of the base to guide a user in forming a similar pattern of wires on the top of the base.

While the Brown patent is similar to the present invention, there are critical differences between the two inventions. The pins of Brown, since they extend through the base is not as stable as a applicant's base which does not have pins extending through the bottom. In addition, since the pins extend through the base of Brown, the amount of space available for a design is limited. Since applicant's base does not have pins extending through the bottom the entire area of the top and bottom of the base is available for a pattern (on the bottom) and the actual design (on the top).

Also, the absence of pins through the bottom increases the types of patterns that can be used with the device. For example, Brown's device is basically limited to using a three dimensional pattern on the bottom of his base. However, since applicant's design utilizes a flat, unencumbered bottom, any pattern, including a two dimensional drawing, photograph, or copy from a magazine or book can be used with applicant's invention. This makes applicant's invention more versatile and easier to use then the device of Brown.

U.S. Pat. No. 3,653,411 to Mosher discloses a harness assembly board which has a plurality of bases with apertures and pins which extend through the bases to interconnect the plurality of bases.

U.S. Pat. No. 5,632,086 to Helwig discloses a jewelry wire bender which has a non-transparent base and pins which are attached to the base and around which wire can be bent in order to form pieces of jewelry. Some of the pegs are of different sizes to produce different designs in the finished jewelry product.

While the other prior art patents work for their intended purposes, they all have drawbacks. The most serious drawback is being able to use the jigs to bend wire into an accurate pattern. Prime (U.S. Pat. No. 1,114,384) has solved this problem by placing a mark or scratch onto the surface of the jig which will guide the user in bending the wire into the desired pattern. However, this method of permanently marking the jig reduces the jig to a one time or one pattern use. In the area of jewelry making, different patterns must be used in order to constantly offer customers something different. Therefore, using the jig of Prime would require the use of a large number of jigs to satisfy the demand for different shaped jewelry pieces.

Tarbox (U.S. Pat. No. 4,483,373) has solved this problem by placing a pattern sheet on top of the jig and holding the pattern sheet in place using wire frames. The use of the wire frames makes the jig more expensive and time consuming if and when the user wants to change patterns. In addition, by placing the pattern sheet on the top of the jig, where the wire is being wrapped, the pattern sheet is susceptible to damage from the wire.

What is need is a jig in which the patterns can be easily changed in order to make different shapes of jewelry pieces, and one in which the pattern will be protected during the wire bending process so the pattern can be used over and over.

SUMMARY OF THE INVENTION

The present invention is a wire bending jig which has a plurality of apertures extending into the top face of the jig but stopping short of the opposite or bottom face. A plurality of pegs are placed into selected apertures to define a pattern for bending wire around the pegs into a specific shape. A pattern of the specific shape is attached to the bottom face of the jig, and the jig is transparent so the pattern can be seen from the top face, and so the pattern will be protected during the wire bending process.

It is an object of the present invention to provide a new and improved jewelry wire bending jig which has a pattern to guide the user in bending the wire into a specific shape.

It is an object of the present invention to provide a new and improved jewelry wire bending jig which allows the pattern to be replaced with a new pattern easily.

It is an object of the present invention to provide a new and improved jewelry wire bending jig which protects the pattern during the wire bending process.

These and other objects and advantages of the present invention will be fully apparent from the following description, when taken in connection with the annexed drawings.

DESCRIPTION OF THE PREFERRED EMBODIMENT

Figure 1:
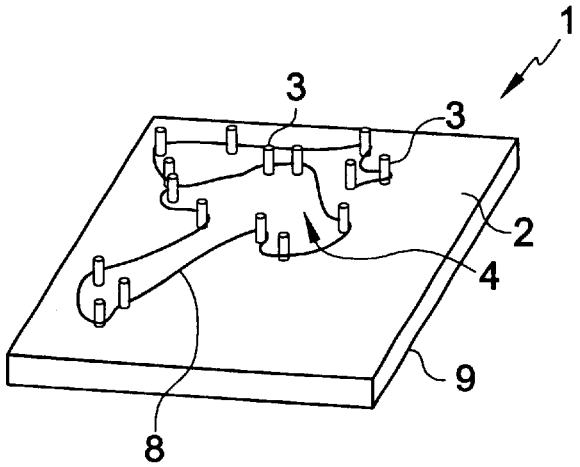
FIG. 1 is a perspective view of the present invention.
Figure 2:
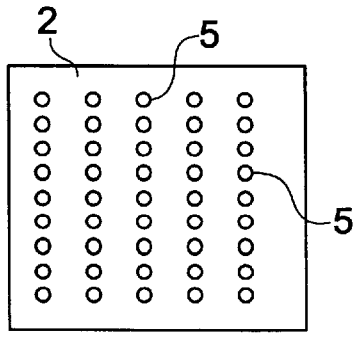
FIG. 2 is a top view of the jig base of the present invention.

Referring now to the drawings in greater detail, FIG. 1 shows the present invention 1 with a selected pattern 4 in place on the bottom surface of the jig base 2. Pegs 3 have been placed in selected apertures 5 (see FIG. 2) and the pattern 4 has been used to indicate the proper position of the pegs 3. It should be noted that the apertures 5 which are not being used are not shown in FIG. 1 for the sake of clarity.

The jig base 2 is made from a transparent plastic such as, but not limited to, plexiglass. Since this material is transparent, the pattern 4 can be secured to the bottom face 9 of the base and the user will be able to easily see the pattern from the opposite of top face. Placing the pattern 4 on the bottom face 9 will protect the pattern 4 while the wire 8 is being bent around the pegs 3 (see FIGS. 1 and 3). In this manner, the pattern can be made from any type of material, such as ordinary paper, and it can be expected to last for a significant period of time. Therefore, the pattern will not have to be replaced after every use.

Figure 3:
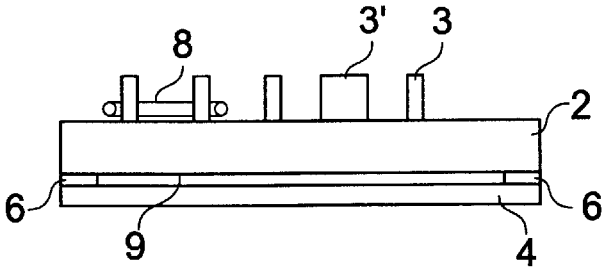
FIG. 3 is a side view of the present invention.
Figure 4:
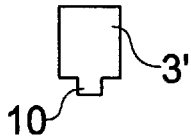
FIG. 4 is a side view of one of the alternative pegs that can be used with the present invention.

As shown in FIG. 3, the pegs 3 can be of different diameters 3' if the user desires, or finds it necessary, for the production of a particular piece. Different diameter pegs 3' can be inserted into the same size apertures 5 by reducing one end 10, as shown in FIG. 4 so the end 10 will be approximately the same size as the apertures 5. whether the user is employing the pegs 3 or the pegs 3', the pegs will engage the apertures in a friction fit so they will be secure within the apertures and will not "pop" out as the wire 8 is wrapped around the pegs.

As shown in FIG. 3, the pattern 4 can be secured to the bottom face 9 of the base 2 by applying rubber cement 6 at selected locations. It should be understood that any conventional means that will secure the pattern 4 to the plastic base 2 can be used.

In order to use the jig of the present invention, the user would first select a desired pattern such as the pattern 4 (this pattern is merely for illustrational purposes and it should be noted that any desired pattern may be used) and attach it to the bottom of the base 2. Next he/she will place pegs 3, 3' into position in the apertures in the outline of the pattern. Then jewelry wire will be wrapped around the positioned pegs thereby forming the wire into the shape of the pattern.

If the user wants to make a piece of jewelry in a different pattern, he/she merely removes the first pattern, replaces it with the second pattern and repeats the steps above.

Although the Transparent Jewelry Wire Bender and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A wire bending jig comprising:

a transparent base, said transparent base having a top surface and a bottom surface, said bottom surface being relatively flat and unobstructed by any protrusions, means for supporting a wire bending pattern on said bottom surface, said wire bending pattern having printed matter on at least one side, said printed matter facing said bottom surface and being attached thereto by said means for supporting a wire bending pattern, whereby said printed matter can be viewed through the transparent base, and means for mounting guide pins in said top surface, said guide pins extend into said transparent base, but do not extend through said transparent base.

2. The wire bending jig as claimed in claim 1, wherein said means for supporting a wire bending pattern on said bottom surface is an adhesive.

3. The wire bending jig as claimed in claim 1, wherein said means for mounting guide pins in said top surface is apertures, and said apertures extend into said transparent base, but do not extend through said transparent base.

4. The wire bending jig as claimed in claim 1, wherein said means for supporting a wire bending pattern on said bottom surface comprises a plate, said plate is spaced from said bottom surface to form a slot, said slot accepts said wire bending pattern having printed matter on at least one side.

5. The wire bending jig as claimed in claim 1, wherein said guide pins have different sizes.

6. The wire bending jig as claimed in claim 3, wherein said guide pins are removable from said apertures.

7. The wire bending jig as claimed in claim 3, wherein said apertures are made of single size, and selected guide pins are the same size as said apertures, and other selected guide pins have a first dimension which is larger than said apertures, and said other selected guide pins have a second dimension which will fit into said apertures.

* * * * *